US009981798B2

(12) United States Patent
DeMatteis et al.

(10) Patent No.: US 9,981,798 B2
(45) Date of Patent: May 29, 2018

(54) ARTICLE DISPENSER AND METHODS RELATING TO SAME

(71) Applicants: Robert DeMatteis, Grass Valley, CA (US); Lindsey Blevin, Eureka, CA (US)

(72) Inventors: Robert DeMatteis, Grass Valley, CA (US); Lindsey Blevin, Eureka, CA (US)

( * ) Notice: Subject to any disclaimer, the term of this patent is extended or adjusted under 35 U.S.C. 154(b) by 0 days. days.

(21) Appl. No.: 14/913,932

(22) PCT Filed: Aug. 22, 2014

(86) PCT No.: PCT/US2014/052279

§ 371 (c)(1),
(2) Date: Feb. 23, 2016

(87) PCT Pub. No.: WO2015/031191

PCT Pub. Date: Mar. 5, 2015

(65) Prior Publication Data

US 2016/0280448 A1 Sep. 29, 2016

Related U.S. Application Data

(60) Provisional application No. 61/959,566, filed on Aug. 24, 2013, provisional application No. 61/945,668, filed on Feb. 27, 2014.

(51) Int. Cl.
*B65G 47/14* (2006.01)
*B65G 59/00* (2006.01)
(Continued)

(52) U.S. Cl.
CPC ..... *B65D 83/0817* (2013.01); *B65D 83/0811* (2013.01); *B65H 1/04* (2013.01);
(Continued)

(58) Field of Classification Search
CPC ..... B65H 1/04; B65H 3/32; B65D 83/0817; B65D 83/0811
(Continued)

(56) References Cited

U.S. PATENT DOCUMENTS 3,036,729 A * 5/1962 Asman ..... B65D 5/16 206/449
4,175,673 A * 11/1979 McDonald ..... B65D 83/0805 221/63
(Continued)

FOREIGN PATENT DOCUMENTS

EP 1321372 A1 * 6/2003 ..... A47F 9/042
GB 002298632 A * 9/1996
(Continued)

*Primary Examiner* — Rakesh Kumar
(74) *Attorney, Agent, or Firm* — Advantage IP Law Firm

(57) ABSTRACT

A dispenser that may be loaded with a plurality of interconnected articles with at least one grasping section and that may then be selectively withdrawn one at a time out through an extraction site and indexed for subsequent withdrawal upon removal along with methods of manufacturing and assembling, the article itself, and additional features such as a separator for engaging the article to dispense the article in an open configuration, a restrainer for aiding separation of the articles, and an elevator or ramp for locating the grasping sections of the articles near the extraction site are disclosed herein.

19 Claims, 8 Drawing Sheets

(51) Int. Cl.

| | |
|---|---|
| ***G07F 11/00*** | (2006.01) |
| ***B65D 83/08*** | (2006.01) |
| ***B65H 1/04*** | (2006.01) |
| ***B65H 3/32*** | (2006.01) |

(52) U.S. Cl.
CPC ..... *B65H 3/32* (2013.01); *B65H 2405/115* (2013.01); *B65H 2405/12* (2013.01)

(58) Field of Classification Search
USPC ..... 221/1
See application file for complete search history.

(56) References Cited

U.S. PATENT DOCUMENTS

| | | | | | |
|---|---|---|---|---|---|
| 4,487,318 | A * | 12/1984 | Roen | B65D 83/0805 | 206/494 |
| 5,269,423 | A * | 12/1993 | Nguyen | B65D 83/0852 | 206/494 |
| 5,325,992 | A * | 7/1994 | Koller | A47F 13/085 | 221/33 |
| 5,509,570 | A * | 4/1996 | DeMatteis | B65D 33/001 | 221/303 |
| 6,508,381 | B1 * | 1/2003 | Sadi | A47F 9/042 | 221/282 |
| 8,430,288 | B2 * | 4/2013 | Barella | A47K 10/421 | 220/495.07 |
| 9,278,799 | B2 * | 3/2016 | Yamada | B65D 81/22 | |
| 2006/0060599 | A1 * | 3/2006 | Zychinski | A47K 10/422 | 221/52 |
| 2011/0132920 | A1 * | 6/2011 | Petocchi | A47K 10/424 | 221/45 |
| 2016/0280448 | A1 * | 9/2016 | DeMatteis | B65D 83/0817 | |

FOREIGN PATENT DOCUMENTS

| | | | | | |
|---|---|---|---|---|---|
| GB | 2298632 | A * | 9/1996 | B65D 83/0847 | |
| GB | 2329171 | B * | 5/1999 | A47F 13/085 | |
| GB | 2391538 | A * | 2/2004 | B65D 33/001 | |
| WO | WO003068619 | A1 * | 8/2003 | | |
| WO | WO-03068619 | A1 * | 8/2003 | B65D 33/001 | |
| WO | WO-2005014413 | A1 * | 2/2005 | B65D 33/001 | |
| WO | WO-2007107737 | A1 * | 9/2007 | B65D 33/001 | |

* cited by examiner

ARTICLE DISPENSER AND METHODS RELATING TO SAME

CROSS REFERENCE TO RELATED APPLICATIONS

This application is a U.S. National Stage application of International Application No. PCT/US2014/052279, filed on Aug. 22, 2014, which claims the benefit of Application No. 61/945,668, filed on Feb. 27, 2014, and titled Bag, Dispenser, and Related Articles, and also claims the benefit of Application No. 61/959,566, filed on Aug. 24, 2013, and titled Bag and Dispenser, and which are hereby incorporated by reference in their entireties.

BACKGROUND

1. Field of the Invention

The present invention generally relates to plastic film articles such as plastic bags and sheets and their dispensers and systems. More specifically they relate to a unique bag, sheet, and tissue, and their disposable dispenser cartons and permanent dispensers, for example metal, aluminum, and plastic, and their related systems, suitable for use in retail, supermarket, industrial/commercial, restaurant, and other related applications.

2. Background Art

Plastic bags are commonly used in retail applications to carry food and merchandise, and commonly used in self-serve applications such as bakery departments. Plastic bags dispensed from traditional dispenser cartons are typically extracted out of a die-cut portion on the carton's top surface adjacent the front panel. It is commonly known that plastic merchandise bags dispensed from cartons as such tend to stick together when dispensed, thus multiple dispensing of bags is common. This problem is exemplified in U.S. Pat. No. 5,509,570 (the '570 patent) to DeMatteis (a co-inventor of this application), which quantifies the substantial waste associated with plastic bag dispensing from traditional dispenser cartons. When bags are double-, triple- or multiply-dispensed, it is not uncommon for those bags to be pushed behind the dispenser carton in the store's check-out counter, and subsequently thrown out in the trash, usually by janitorial workers who are doing their job. The bag described in the '570 patent at least provides an improvement over traditional prior art dispenser cartons.

Very little has changed in the last twenty years other than bag manufacturing companies providing dispensing systems comprised of metal racks, hangers, and plastic bag hooks. Examples of these systems are illustrated in U.S. Pat. No. 5,013,290 and U.S. Pat. No. 6,715,260 (the '260 patent), both to DeMatteis. These systems are generally acceptable in many applications, as is commonly seen in supermarket front end applications, and require space atop counters and other working surfaces, such as a vertical wall. They are considered somewhat of a nuisance to be located atop a working surface and are generally unattractive. At times, separate metal holders and dispensers are used for multiple bag sizes, thus magnifying these issues. Without question, retailers prefer not to have bag dispensers mounted atop working counter tops, or alongside the counters on a vertical surface, and would prefer a carton dispenser hidden out of view under a counter. Likewise, for self-serve applications, for example in self-serve bakeries, it is preferred to have dispenser cartons that fit into the bag compartments located under the pastry cabinets instead of mounting them on some form of external hook or rack. In this particular instance, the appearance of the bakery area is important to retailers, and mounting external holders takes away from an otherwise attractive, clean, professional appearance.

Dispensing bags from traditional prior art dispenser cartons typically take about 10-13 seconds to extract a bag, find the bag mouth opening, grasp the two opposing handles, open the bag, and set it upright on a counter top, ready for loading. This is assuming that multiple bags are not accidentally dispensed and that the two opposing bag walls don't stick together, which foils the ability to grasp the two opposing bag walls and open it up, further increasing the time required to dispense and prepare a bag for loading. This exemplifies why bags dispensed from hooks and racks are more prevalent in higher volume retailers. It is commonly understood that the relatively long time frame to prepare a bag for loading when dispensed from traditional prior art cartons is unacceptable in retail stores, supermarkets, restaurants, and so on. Such a long time frame to dispense a bag, and prepare it for loading, adds up over the course of a year to a rather enormous labor expense for larger retailers.

The use of certain prior art products such as Dual-Tab® bags can significantly improve dispensing as they tend to avoid multiple-dispensing, and the bags also open up when dispensed. This is illustrated in U.S. Pat. No. 4,759,639 to DeMatteis and U.S. Pat. No. 5,497,884 (the '884 patent) to DeMatteis et al. While these bag styles improve dispensing and productivity and reduce waste, they cost more to manufacture and package into their dispenser cartons.

Another merited bag dispensing system is one that dispenses from a hook and leaves no residue (bag tab) behind. This is illustrated in U.S. Pat. No. 5,881,882 (the '882 patent) to Fletcher et al. However, carry bags with or without die-cut handles—not T-shirt bags—in this configuration tear a portion of the bag top as illustrated in FIGS. 9-12 of the '882 patent. This causes two new problems, one being a weakening of the bag top where a die-cut handle is located, and two, it creates an unattractive appearance. The bags disclosed in the '260 patent on the other hand leave no tears in the bag construction and have an attractive wave-top appearance. All of these bag dispensing systems have merit for dispensing bags one-at-a-time and speeding up productivity, but all require some, form of external hook or rack, with the exception of the bag system disclosed in the '884 patent, which has the added cost of a retaining hook system affixed within the carton.

Other one-at-a time dispensing systems for plastic bags include a multitude of roll bag configurations, most of which use a detent as a retainer to separate a bag being dispensed from the next bag on the roll. An example of such a roll bag and dispenser is illustrated in U.S. Pat. No. 6,234,431 (the '431 patent) to Simhaee. Other roll bags are illustrated in U.S. Pat. No. 5,209,371 (the '371 patent) to Daniels and U.S. Pat. No. 5,170,957 (the '957 patent) to Carpenter. While roll bags offer certain efficiencies in manufacturing, they are rarely a consideration for larger, thicker carry bags, and those that require better quality print copy such as those used in department stores and restaurant take out bags. Roll bag manufacturing operations are well-known for their generally inferior print ability. Roll bags also tend to be impractical for use in high volume outlets where productivity is important when dispensing, opening, reading, and loading bags, which is time consuming. Much like the traditional dispenser carton, they take 10-13 seconds to complete the dispensing operation and prepare for loading.

Perhaps the biggest detriment of all external racks and hook dispensing systems, as described for example in the '431, '371, '260 and '882 patents, is the substantial cost to purchase and install the hardware. It also requires reasonably experienced employees to properly install the racks and hooks. The initial cost is usually born by the bag manufacturer, but accounted for in its sales price (and usually with a long-term supply contract). Also, racks and hooks tend to break and require replacement, which replacement costs are subsequently born by the retailer.

In addition to bags being dispensed one-at-a-time, the same benefit holds true for a myriad of tissue sizes and types used in bakery and other sheet uses such as a meat department or deli. Other sheet type applications include tint strips used in the salon trade. Hair stylists use them when applying coloring to a customer's hair. The tint strip is laid atop a lock of hair that has been treated with a tint chemical, which is then folded up in the tint strip. The tint strip prevents the tint chemical from inadvertently touching, and thus tinting adjacent sections and locks of hair. Traditional tissue and sheet dispensing systems are generally like that described in U.S. Pat. No. 3,269,593 (the '593 patent) to Lodewick.

The equipment that manufactures interfolded tissue as described in the '593 patent is generally expensive with fixed sizes. It is conceivable this technology could be used in the bag industry but would be extremely costly. Likewise, changing from tissue to bag manufacturing would be impractical and would most likely require new machinery altogether. There would be little flexibility with sizing in these types of interleaved manufacturing systems.

Plastic bags, tissues, and sheets that are attractive and useful, and can be dispensed from a carton without an additional cost for new bag machines (interleaving or otherwise), machine conversion, hardware installation, added carton expense, and so on, and overcome the numerous problems associated with prior art dispensers would be valuable to these trades and many others.

SUMMARY

The disposable and permanent dispensers, plus the plastic bags and articles of the present invention, overcome the problems associated with prior art. The dispensers of the present invention dispense articles such as bags, sheets, or tissues one-at-a-time by utilizing interconnected bag packs or article packs, a unique combination of a separator, a retainer, and elevator, and at times a restraining dispenser cut-out. The separator serves unlike a detent in that it does not resist separation of film articles such as bags on a roll, like those illustrated in the '431, '371 and '957 patents. Instead, the separator of the present invention allows the film plies of a first bag or tissue article to slide over it, as the first article pulls a top wall of a second interconnected article up and over the separator through a weak bond between their outer film surfaces. The weak bond then releases as the top wall of the second article falls back down atop the separator, thus it is immediately ready to be grasped and dispensed. Upon executing the dispensing operation, a dispensed bag article automatically opens wide, and can be quickly set atop a counter, ready for loading in a matter of a few seconds. A dispensed tissue is firmly grasped in the user's hand, or as revealed herein it may be effectively hooked through an aperture. These dispensing operations are impossible with the '431, '371 and '957 bags, or any other common plastic bag dispensed from a carton or permanent fixture, with the exception of the '884 bag. However, as required with the '884 bag, the present invention does not require the added hardware inserted in the carton, nor the added labor to load the stacked bags during the manufacturing operation. The elimination of the internal hardware that secures bag packs to the dispenser improves environmental properties and reduces cost by 3%-5% or more. The tissue/sheet dispensing operation of the present invention would also be impossible with any traditional type of interfolded or cut sheets, regardless of material.

Furthermore, where the prior art bags on rolls and common merchandise bags using traditional dispenser cartons require 10-13 seconds to completely dispense, open and prepare for loading, the bag of the present invention is ready for loading in about 3-4 seconds. Considering that labor rates in the United States would be effectively calculated at $20 per hour (includes tax liabilities, expenses, insurance, etc.), that computes to about ½ cent per second. Thus, there is an added labor cost of $0.035-$0.045 per prior art bag when dispensed and loaded by an employee. For a large retailer or industrial bag user who dispenses 10 million food or retail bags a year, the extra labor cost equates to about $350,000 to $450,000 annually. Likewise, prior art tissue and sheets tend to dispense efficaciously, however, larger sheets and items like tint strips or deli sheets that are stacked in boxes and cartons, tend to be cumbersome and can take from 5-8 seconds to prepare for use, whereas the present invention takes about 1-2 seconds to grasp and put into use. It will be clearly demonstrated that the use of the bag and sheet articles of the present invention save substantial time and labor.

The present invention also incorporates the use of a novel retainer that is inserted inside the dispenser, atop a stack of articles, which helps retain the bag or sheet article stacks in place during the dispensing operation. This is generally not required with heavier bags and sheets. However, with thin-gauged articles, this simple means of maintaining the stack in a layflat disposition in the dispenser, eliminates the dispensing of multiple articles and instead contributes to the preferred withdrawal of one article at a time. With lightweight film articles, the present invention may also make use of an elevator, which is inserted inside the dispenser prior to stacking the articles inside. As its name indicates, the elevator is a simple, novel way, to cause the stack of articles to rise up during dispensing, all the while maintaining the enclosed bag stack in a layflat disposition. Furthermore, with or without the use of an elevator, retainer, or even a separator, the invention may employ solely a restraining dispenser cut-out (or opening on a permanent dispenser) with a series of interconnected articles packed inside to effect the one-at-a time dispensing operation. This type of configuration may typically be used for more lightweight articles, and requires the right balance of a cut-out/opening that sufficiently restrains; and articles with interconnections whose bonds will effectively break when they are withdrawn through the restricting cut-out/opening.

The dispensing operation of the present invention bags is also natural, instinctive to users, as they dispense articles much like they would a traditional bag from a box. The two primary differences being that a first dispensed bag opens wide in the user's hand when dispensed, and the front wall of the second bag in sequence is always ready to be subsequently grasped and instantly dispensed. Dispensing sheet articles is essentially the same, with a first dispensed tissue automatically prepares a second tissue to be subsequently grasped and instantly dispensed. Whether bag, tissue, sheet or otherwise, the dispensing operation of the present invention is intuitive, that is, little to no training is required.

The present invention used with disposable cartons incurs no additional cost for hardware, racks, hooks, and so on and requires no installation by skilled or unskilled workers. The dispenser carton may be manufactured by most traditional carton suppliers and might cost marginally more than traditional RSC cartons, if anything at all. The carton of the present invention is easy for employees to know how to open and use, as it incorporates a traditional perforated opening, but in a special configuration that delineates the unique separator or dispensing qualities of the present invention. Anyone who has opened any form of traditional dispenser carton, or box of facial tissues, will instinctively know how to open the carton of the present invention.

The present invention used with fixed, permanent dispensers incurs only an initial cost of the dispenser, and may be installed by skilled or unskilled workers. The permanent dispenser may be manufactured by most traditional wire and sheet metal products suppliers and would typically cost no more than traditional plastic bag racks. The permanent dispenser of the present invention is easy for employees to know how to use, as it is intuitive for an employee to insert one or more large cartridges of bags. The permanent dispenser incorporates an opening much like that used in the disposable carton, but its construction is typically made of metal, although not limited thereto, and delineates the unique separator and dispensing qualities of the present invention. Anyone who has dispensed a facial tissue from a box will instinctively know how to dispense article from the permanent dispenser of the present invention.

Furthermore manufacturing of the bag articles of the present invention may be manufactured on highly advanced, high-speed bag machinery—or on antiquated bag machines—in either sideweld or bottom-seal operations. They may be essentially any size, with bottom or side gussets, printed or unprinted, and only require well-understood, minor machinery modifications. They may also include a variety of shapes, handle configurations, and designs that enhance attractiveness, including those along the lines of the Bell Bags™ described in the '570 patent and other bag configurations described herein. More interesting is that the tissue and sheet articles of the present invention can also be manufactured on the same bag equipment with a minor slitting operation.

Another important benefit of the bag and dispenser of the present invention is its effect on the reduction of waste as its one-at-a-time dispensing is clearly superior to the prior art bags and the wastage associated with their respective prior art dispensers. The potential for multiple dispensing is much lower (if at all) than all prior art, including the '884 and '570 bags. It is estimated that 8%-10% of all retail, self-serve bakery bags, and so on, are double dispensed and thrown in the trash.

It is an object of this application to illustrate various preferred embodiments of the disposable carton and permanent dispensers, and methods of dispensing of the present invention, and its unique bags, tissues, and other film articles, and to broadly state the methodologies that may be used in order to manufacture, dispense, and use the dispenser, bags, and other articles of the present invention.

DETAILED DESCRIPTION

For ease of explanation, only the disposable carton version of the present invention will be described in detail. Any person who is experienced in the art will easily understand how the permanent dispenser version of the present invention would thereby be constructed.

A. Description of an Exemplary Carton

Figure 1A:
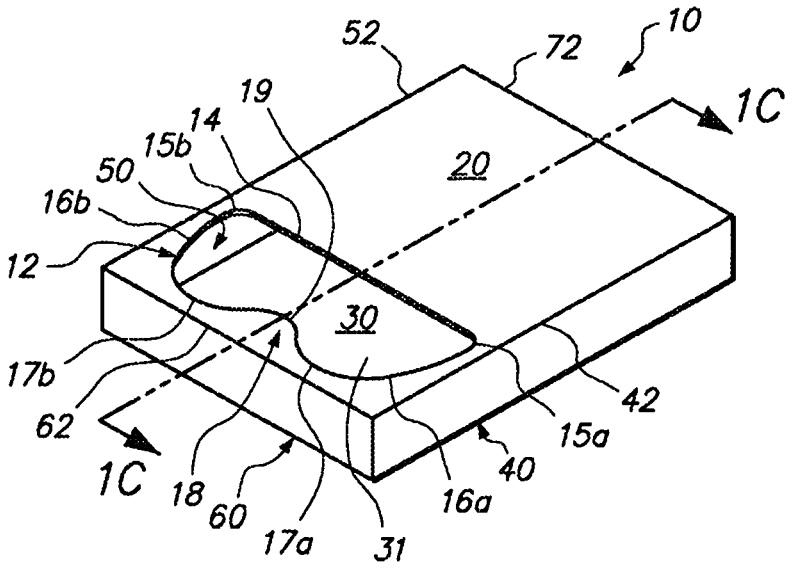
FIG. 1A is an upper, right hand, perspective view of an exemplary empty carton in accordance with the principles of the present invention.

Referring now to FIG. 1A, in accordance with the principles of the present invention, a first embodiment of a dispenser in the form of an empty carton or container body, generally designated 10, is illustrated. The carton body is constructed with a top panel 20, an opposing bottom panel 30, a pair of opposing side panels 40 and 50, front end panel 60, and a rear end panel 70 (FIG. 1C), which opposes front panel 60. In this exemplary embodiment, within the confines of the top panel 20 is a perforated dispensing cut-out 12 defined by rear line 14 extending across top panel 20 from a point 15*a* recessed from side edge 42 to a point 15*b* recessed from side edge 52, two spaced apart side lines 16*a* and 16*b* which are connected to rear line 14 at rounded corner points 15*a* and 15*b* respectively and extend toward the front end panel 60 in a soft arc to points 17*a* and 17*b* located interior to the front panel edge 62. Between side lines 16*a* and 16*b*, extending rearward from points 17*a* and 17*b* is a separator 18 with its rearward extremity forming a ledge or tongue generally defined by a rounded arc 19. From a top view of the carton 10, the cut-out 12 somewhat resembles a pair of ski goggles or a recurve bow at the front end with a straight rear edge (rear line 14) joining the recurve section (side lines 16*a*, 16*b*, and rearward extension 19) at opposing rounded corners 15*a*, 15*b*. The cut-out (also referred to as an aperture, opening, egress site, or extraction site) provides an opening for withdrawing articles stored in the article storage chamber 31 from the carton body 10 as explained further below. Moreover, the interaction between the edges of the cut-out and articles being withdrawn facilitates single article withdrawal, opening of the withdrawn article, and indexing of the next adjacent article for rapid removal. In this exemplary embodiment, the rear line 14 forms a trailing edge while the leading edge is generally formed between the points 17*a* and 17*b* and includes the rounded arc 19 of the separator 18 relative to the direction the articles are withdrawn toward the front end panel 60 as described below.

Figure 1B:
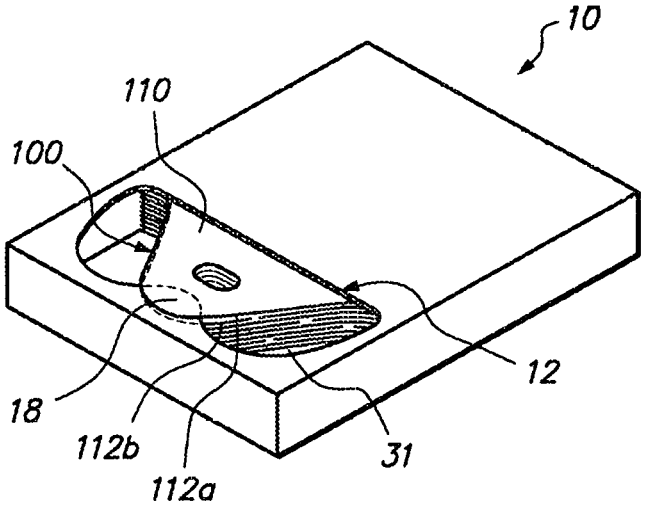
FIG. 1B is a similar view to FIG. 1 with a stack of exemplary bag articles packed inside and a first bag ready for dispensing.

With continued reference to FIGS. 1A-1B, the top panel 20 of the carton 10 may be formed with perforated cut-out or punch out lines 14, 16*a*, 16*b*, and 19 allowing a complementary section (not shown) to be broken out and removed in use to define the dispensing cut-out 12 as illustrated and expose an interior article storage chamber 31 defined by the panels (20, 30, 40, 50, 60, 70) of the carton. These perforated lines with the inner cut-out panel intact may be fabricated when the carton 10 is manufactured and may then be subsequently extracted by a store employee to prepare the bag contents for dispensing. It will be appreciated that the carton may also be formed with the opening during manufacturing to eliminate the step of removing the cut-out section prior to use if desired.

Figure 5A:
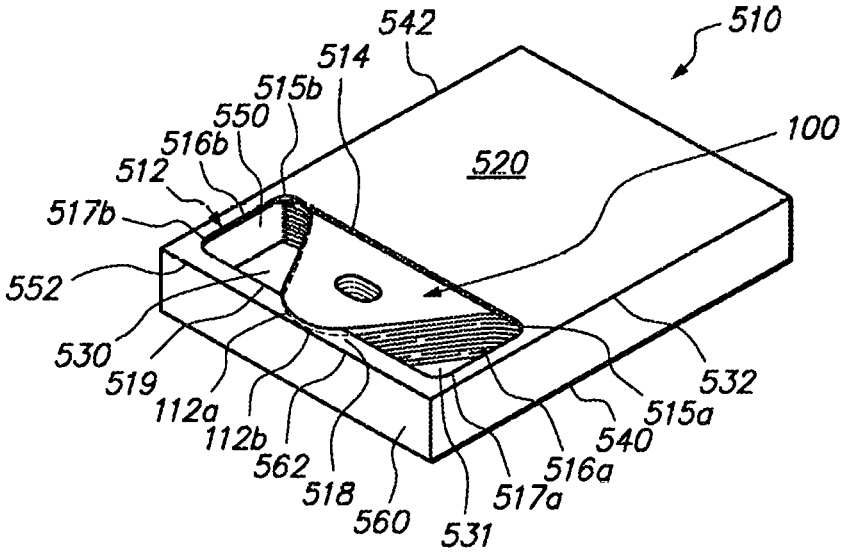
FIG. 5A is a similar view to FIG. 1B illustrating another embodiment of the dispenser with the front die-cut line in the dispensing opening serving as the separator in accordance with the principles of the present invention.

While the ski goggle shape of the dispensing cut-out 12 in FIG. 1A may be the preferred embodiment for the carton of the present invention, it is not necessary to have rounded corners and lines, nor is it necessary to have a round tip 19 on the separator 18. Straight, rectangular lines will suffice. However, for ease of extracting the inner cut-out panel, round lines tend to extract cleaner and more easily than those with sharper corners. Likewise, the rounded corners on the separator are preferred to allow the bag to efficaciously dispense. Other variations of the separator 18 may have a minimal rearward extension, or none at all, as illustrated in FIG. 5A. The only requirement for the opening 12 being that the rearward facing edge of the separator section 18 is in close proximity to the top portions of the bags 1000 (FIG. 1C) so the separator section may isolate or index the dispensed bags as further described herein.

With continued reference to FIGS. 1A-1B, the carton 10 of the present invention is preferably made with any style of tray type dispenser carton, whether it is two-piece with a top and bottom, or a one-piece carton hinged along the rear wall edge 72. The tray type dispenser carton is superior for shipping as it provides double wall thickness along all outer panels 40, 50, 60 and 70, whereas the one-piece version has a double wall thicknesses along all panels except rear panel 70, which is a single wall. The double walls substantially improve stacking of cartons and palletizing, as well as aiding in the stacking of pallets, at time 3- to 4-high. The dispenser of the present invention may also be made in a variety of other carton configurations, such as regular slotted carton (RSC), as long as there is a clean top portion suitable for locating the dispensing cut-cut. The cartons may be constructed of stiff paper, cardboard, plastic, wood, metal, a combination thereof, or other suitable materials commonly used to construct boxes for holding articles.

While the exemplary dispensing cut-out 12 illustrated in FIG. 1A is located on the top panel near front panel 60, the cut-out may also be located in a more central location on the top panel (or other panel), and at times may be incorporated partially on the top panel overlapping onto one of the outer panels such as the front panel 60 for example. It may even be incorporated solely in a front panel for certain types of cartons and bags. Regardless of location, the dispensing system of the present invention essentially operates in the same methodology regardless of location, size, and so on, providing it has a suitable separator to dispense bags as disclosed herein.

Referring now to FIG. 1B, the article storage chamber 31 of the carton 10 of FIG. 1A may be loaded with a set of articles (also referred herein as cartridges, packs, stacks, bags, sheets, tint strips, or tissues), generally designated 1000 (FIG. 1C), with the articles being preferably interconnected. Other suitable articles for use with the dispensers described herein will occur to one of ordinary skill in the art. In this first exemplary embodiment, the articles are in the form of bags with a first uppermost bag, generally designated 100, in a ready for dispensing configuration. In this ready for dispensing configuration, a top handle portion 112*a* of a top (or outermost or uppermost) bag wall 110 extends outside the interior chamber 31 (FIG. 1A) of the carton by projecting through the dispensing cut-out 12 and resting atop separator 18. The top handle portion 112*a* is freely separated from its opposing bottom handle portion 112*b* of an opposing bottom bag wall (not shown) by the separator 18, and allows the bag 100 to be dispensed in an open disposition as further described herein.

Still continuing with FIG. 1B, it will be appreciated that the disposition of a first bag 100 in carton 10 as illustrated occurs automatically after the dispensing of each previously dispensed bag in the bag packs contained inside carton 10. Regardless of whether the bag has a die-cut handle or not, it will be ready for a user to grasp and dispense a top bag article as illustrated in FIG. 1B. It is important to note that standard rectangular bags without die-cut handles may be dispensed in essentially the same manner as described herein. The carton and dispensing system of the present invention is not reliant on the bell shape of the preferred bag described herein.

Figure 1C:
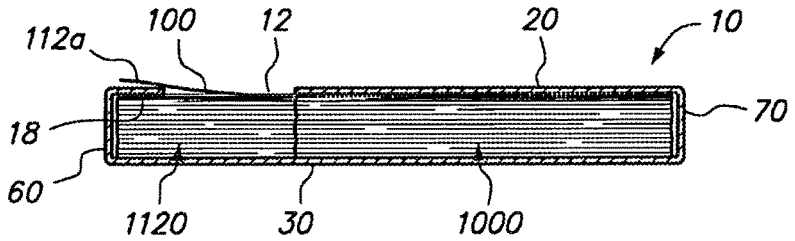
FIG. 1C is a side cutaway view taken along lines 1C-1C of the carton and bag articles in FIG. 1B.

Turning now to FIG. 1C, the side cutaway view of carton 10 of FIG. 1B illustrates an exemplary bag pack 1000 stowed inside the article storage chamber 31 (FIGS. 1A-1B) and aligned with its top handle portions, generally designated 1120, in a front facing disposition toward the front panel 60, and spaced just below, or near, the dispensing cut-out 12. In this configuration, the top handle portion 112*a* of the first bag 100 rests atop separator 18 and outside the chamber 31, in an open configuration ready for dispensing.

As previously stated, a more permanent dispenser may be configured out of wire or sheet metal with the same attributes as the carton 10 described in FIGS. 1A-1C, and fixedly mounted on a suitable shelf or counter top. It may also be suitably mounted on a vertical surface where bags or articles are dispensed upside-down and outward from the dispenser opening.

B. Description of an Exemplary Bag Pack

Figure 2A:
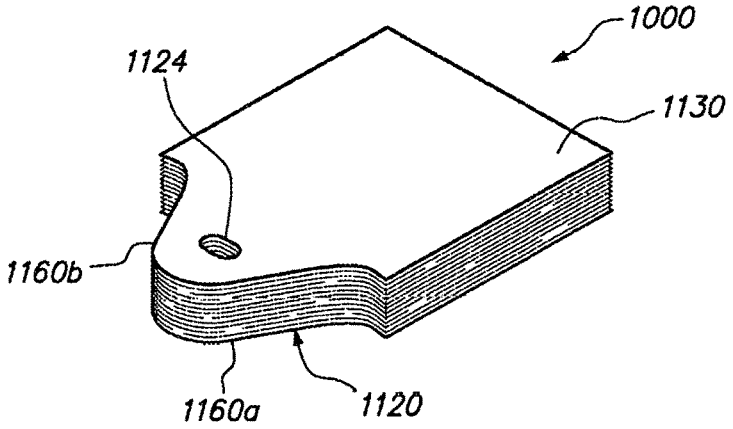
FIG. 2A is a similar view to FIG. 1B with the dispenser removed leaving the exemplary stack of bags.

Referring now to FIG. 2A, the exemplary bag pack (or cartridge) 1000 of FIG. 1C is illustrated as a plurality of stacked bags, one atop the other, and interconnected to one another in their top handle portions 1120 by weak bonds between the outer surfaces of each sequential bag in the stack. These weak bonds between bags may be created in the die-cut operation that defines the shoulders 1160*a* and 1160*b*, which form the top handle portions 1120, and also creates die-cut handles 1124. The weak bonds are formed when the die-cutting operation compresses the bag plies along a die-cut line and bonds together the outer film surfaces, as described in the '260 and '290 patents. Interconnections may also be formed along die-cut handles 1124 without the requirement to have shouldered bell-shaped bags. Weak bonds on outer bag surfaces are created primarily due to the static electric treatment on outer bag surfaces when roughing them up for printing, and allow the outer surfaces to be entangled, meshed together, when pressure is applied along a die-cut line, such as in a die-cutting operation. The bags may also be interconnected through the application of pressure points as described in the '882 patent. They may even be interconnected by a releasable glue, pinpoint adhesive, or static electricity for that matter. As will be illustrated in FIGS. 3A and 3B, the interconnection between the bags facilitates the dispensing action of the present invention regardless of how the interconnections are made.

Figure 2B:
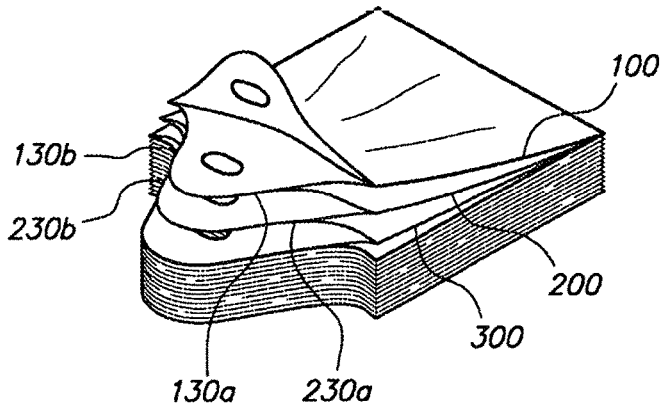
FIG. 2B is a similar view to FIG. 2B illustrating the accordion effect of interconnections between bags in the bag pack of FIG. 2A.

Continuing with FIGS. 2A-2B, the bag pack 1000 may be manufactured in traditional bag making operations where traditional die cut operations are applied. In doing so, bags typically contain 50, 100, or at times 200 bags in a pack. In such a bag manufacturing operation, the bags are typically made in rectangular shapes, stacked, and then subsequently punched with a single die-cut operation that forms the handles and may or may not further shape the top handle portions 1120 of the bags. In the case of the bag pack 1000 of the present invention, the die-cut operation would typically simultaneously form the handle and the bell-top shape. These bags may be made according to the manufacturing methodology described in the '882 patent or in U.S. Pat. No. 6,186,933 (the '933 patent) to DeMatteis or other manufacturing technologies with out of line die-cut punching operations. In this exemplary embodiment, it will be appreciated that the bags have a top handle portion 1120 and a distal holding section or tail section 1130 formed of opposing front and back panels joined together at their respective side and bottom edges. In the preferred embodiment, the top handle portion is disposed proximate the front end panel 60 and extraction site 12 while the tail section is disposed near the rear panel 70.

In the event that it would be desirable to have multiple bag packs 1000 stacked on top the other inside the carton of the present invention, for example five bag packs of 200 bags, creating a single carton with 1000 bags, then the bag packs may be interconnected by applying a small amount of releasable (also called restickable) adhesive, such as that used in 3-M glue sticks 6314 and 6307, or any common hot melt glue, to the top handle portions of the top (and/or bottom) bag in each stack. Thus, the bag packs are stacked in a dispenser carton of the present invention, bonded together, with the first bag and last bag of each stack are weakly bonded together, forming one large cartridge of bags. The entire cartridge of individual bag stacks is then interconnected from the bottom surface of the first bag in the uppermost stack to the top surface of the last bag in the bottom stack. The exception would be the top surface of the first (top) bag in the cartridge would not be interconnected, or perhaps folded over as illustrated in FIG. 5C.

Furthermore, it may also be advantageous to use a small portion of hot melt to wealdy bond the entire cartridge of bags 1000 to a base portion 30 (FIG. 1C) of the dispenser carton 10 (FIG. 1C). By doing so, it improves the one-at-a-time dispensing of the last bags in the box. Typically, this weak hot melt bond is between the rear outer surface of the last bag in the cartridge and is releasably attached to the top surface (inside the carton) of the base 30 of the carton. Depending on the size and the force of the interconnections of the bags, this releasable bond may be located near the tail end of the bag cartridge, and at times near the top end (near the open mouth portions). It may also be advantageous to have releasable bonds at both ends to further maintain the cartridge inside the dispenser carton creating efficacious dispensing of the last bags. The releasable attachment of a cartridge of bags may also be between the rear outer surface of the last bag and the top surface of any insert inside the carton, such as an elevator or ramp. This releasable bond (hot melt or otherwise) may also be applied to the use of bags and cartridges of the present invention in metal or other forms of permanent dispensers.

The bag manufacturing operation of the bag pack 1000 of the present invention may also be partially or fully automated. This may be accomplished much like the process described in the '882 or '933 patents where individual bag packs are formed. However, instead of grippers grasping bag packs and moving them onto a conveyor belt, the individual bag packs of interconnected bags are stacked, one atop the other, on a secondary station. The bag pack stacking process may be further automated by applying an interconnecting adhesive between the individual bag packs, thus forming one large cartridge of interconnected bag packs. The result is all bags in the cartridge are therefore interconnected, from the first bag to the last. The releasable adhesive may be applied when the die-cutting operation forms the individual bag packs, or when the grippers are stacking the individual bag packs one atop the other. One last automated methodology remains, in which the newly formed large cartridge of interconnected bag packs is inserted into a suitable dispenser carton. Upon insertion of the bag cartridge into a dispenser carton, it may be likewise releasably attached to the carton base as described in the preceding paragraph. Or, the resultant cartridges of bags may be bulk packed for subsequent use in a permanent dispenser.

In the event the present invention is used with plain, unprinted bags, a strip treater may be added to the automated manufacturing process previously described, whereby the treated outer surfaces of the unprinted bags may be suitably interconnected in a subsequent bag stacking operation. Regardless of when the bag film is treated, a bag stacking operation using bag stacking pins and/or sufficient pressure is sufficient to create interconnections between the bags in the stack.

In FIG. 2B the accordion effect of interconnections as described in FIG. 2A between bags in bag pack 1000 of the present invention is illustrated. As shown in FIG. 2B, when first bag 100 is pulled upwardly, the interconnection between the first bag 100 and the next adjacent bag 200 is shown, which in turn shows that bag's (bag 200) interconnection with the next adjacent bag 300. As illustrated in FIG. 2B, the interconnections between bags 100 and 200 are along the die-cut lines 130*a* and 130*b* forming the shoulders of bags 100 and 200 while the interconnections between bags 200 and 300 are along the die-cut lines 230*a* and 230*b* forming the shoulders of bags 200 and 300. The interconnections between the remaining bags in the bag pack are respectively formed in the same manner. The exception to the foregoing being the interconnections of bag packs as previously described, whether the bag packs are interconnected manually, or partially or fully automated.

C. Description of Exemplary Bag Loading and Dispensing

For ease of explanation, only the disposable carton version of the present invention will be described in detail. Any person who is experienced in the art will easily understand how the more permanent dispenser version of the present invention would thereby be constructed.

Figure 3A:
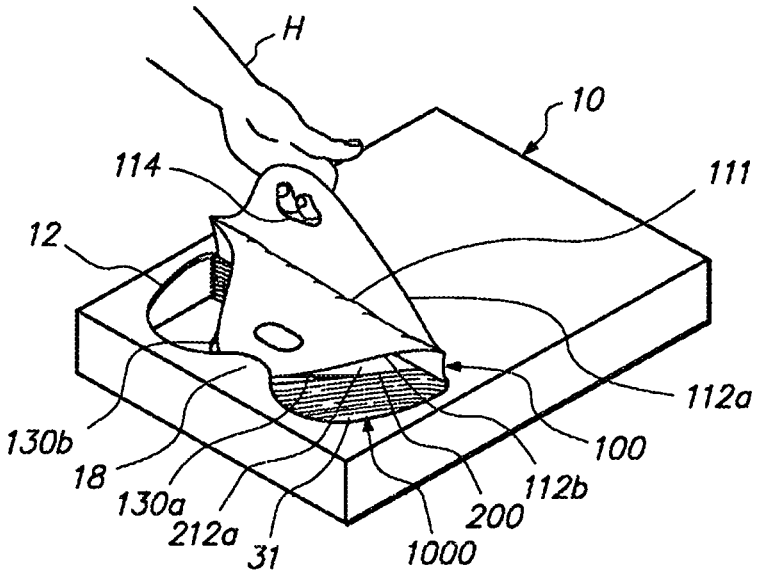
FIG. 3A is a similar view to FIG. 1B with the first bag article of the bag pack being dispensed from the carton.
Figure 3B:
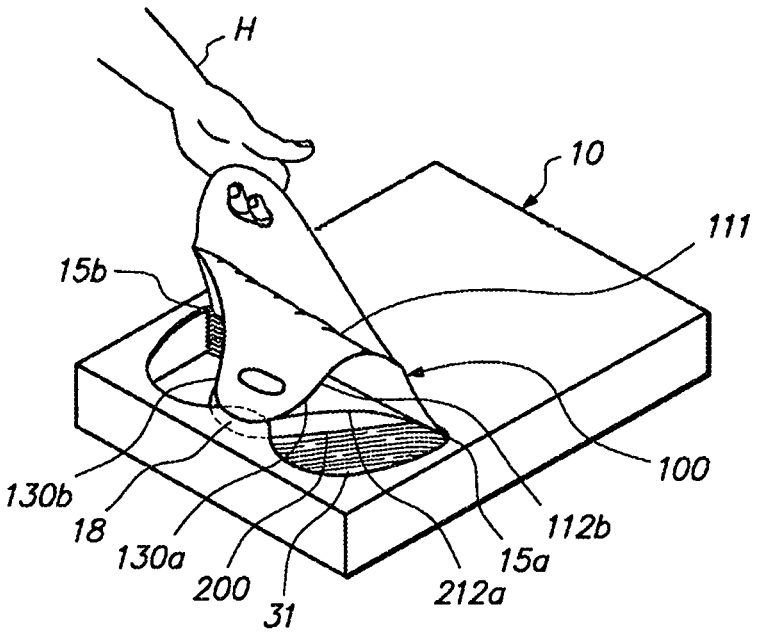
FIG. 3B is a similar view to FIG. 3A illustrating a subsequent stage of dispensing the first bag article with the top wall of the second bag in sequence being readied for a future dispensing.

Turning now to FIGS. 3A and 3B, prior to dispensing bags, using the bag generally designated 100 as an example, the carton 10 and bag 100 of the present invention appears like that illustrated in FIG. 1B. This is the loaded, ready for use configuration with the bags loaded into the carton and top handle exposed and resting on the separator 18. In FIG. 3A, the act of dispensing a first bag article 100 of bag pack 1000 from carton 10 is in progress as user's hand H grasps a grasping region of the first bag article 100 formed by a die-cut handle 114 located in top handle portion 112*a* and is pulling forward and upward, thereby partially extracting the bag 100 out of the article storage chamber 31 (FIG. 1A) or cartridge chamber through the dispensing cut-out 12. As bag 100 is extracted out through the dispensing die-cut 12, its bottom handle portion 112*b* remains in place, underneath separator 18, attached to bag pack 1000 due to the interconnecting bonds at locations 130*a* and 130*b*, which bonds are between bottom handle portion 112*b* of bag 100 to top handle portion 212*a* of second bag 200. It is during this dispensing operation that bag mouth 111 opens and will in fact be substantially wide open upon completion of the dispensing operation. During this operation, the remaining bags in bag pack 1000 remain firmly in place due to their interconnections and their sheer weight being substantially greater than first bag 100.

Turning now to FIG. 3B, the dispensing operation of FIG. 3A is further along with the first bag 100 being further extracted and the bag mouth 111 is wide open. The weak bond between bottom handle portion 112*b* and top handle portion 212*a* of second bag 200 is sufficiently strong to remain connected as bottom handle portion 112*b* has extracted top handle portion 212*a* up and over separator 18. In the exemplary embodiments described herein, the weak bond is sufficient to lift top handle portion 212*a* upward and out of the dispensing die cut 12 due to the fact separator 18 does not resist the accordion effect of the bag plies, and allows a top handle portion to separate apart from a bottom handle portion, and slip over separator 18. It is now easy to understand that upon the final extraction of bag 100, the weak bond between its rear handle portion 112*b* and top handle portion 212*a* of bag 200 are insufficient to extract the entire weight of bag 200. The bond is also further or alternatively encouraged to break due to the resistance of bag 200 being retained between carton cut-out edges, typically at the locations of points 15*a* and 15*b* and along rear die-cut line 14 (see FIG. 1A). An example of a suitable weak bond is a bond commonly used in self-opening plastic T-shirt bags or those used on bags described in the '260 patent. Other suitable bond strengths having the functionality described herein will occur to one of ordinary skill in the art. Once the dispensing operation has been completed, bag 200 becomes a first bag 100 with top handle portion 212*a* becoming top handle portion 112*b* as it now rests atop separator 18. This new first bag 100 now appears as illustrated in FIG. 1B and is ready to be dispensed in the same manner described herein with its uppermost handle 112*a* indexed atop the separator 18. Given such an operation, it will be appreciated that only bag is withdrawn at a time.

The dispensing operation illustrated in FIGS. 3A and 3B is natural for store employees and self-serve customers to perform. With a die-cut opening and a single ply handle resting atop the opening that is easy to grasp, a user instinctively identifies the free top handle portion 112*a* and intuitively extracts the bag, in much the same operation as he may extract a tissue from a Kleenex® carton. Bag withdrawal and removal easily occurs regardless of whether the bags are dispensed from a suitable counter top, under the counter from a shelf, even a vertical surface. In fact, bags may be dispensed outward, upward, and upside down. Upside down dispensing on a vertical surface only requires separator 18 to extend a little longer or larger to prevent bags from settling downward. The difference is that the present invention does not use interleaving to cause a first article surface to "pop-up", but uses the previously described properties of plastic bags to create the interconnections. It should also be understood that bags having unintentional interconnections between them are considered one of the primary causes of undesirable multiple dispensing with traditional prior art dispensers.

Figure 3C:
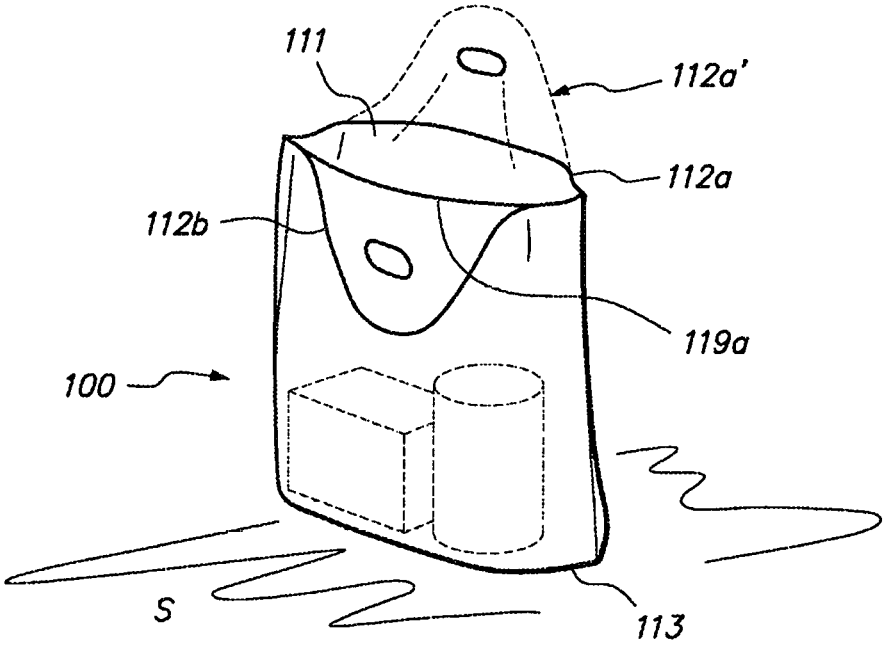
FIG. 3C is a upper, right hand, perspective view of an exemplary dispensed bag of FIGS. 3A and 3B, completely dispensed from the carton and set upright ready for loading.

Referring now to FIG. 3C, the dispensed bag 100 from FIG. 3B has been completely removed from the carton 10 (FIG. 3B) and set upright with bag mouth 111 open and ready for loading. Since bag mouth 111 leading to the main body of the bag that forms the holding or working section of the bag was opened wide during the dispensing operation, while the user grasped and pulled on the top handle portion 112*a*, it is then easy for the user to grasp the opposing bag handle 112*b* after the bag has been fully extracted, pop bag 100 open, which is a common user methodology, and set the bag down upright on a countertop S with bottom gusset 113 (also see FIG. 4A) opened up, resting flat atop the countertop surface. As illustrated, the handle portion 112*b* is folded down folding generally along fold line 119*a*, out of the way for easy loading, whereas handle portion 112*a* may also be folded down, or may retain an upright disposition as it points slight outward, away from bag mouth opening 111 as depicted by dashed linens 112*a*. Regardless of whether the bag handles are folded down or remain pointed outward, it is the bell shape of bag 100 that allows it to maintain an open disposition. A soft bell shape, as in the '260 patent does not tend to pooch outward, nor fold down as the case may be. The ability for bag 100 to stand upright as illustrated is enhanced with bags made from a sideweld construction of the front and rear panels of the bag and with a bottom gusset.

The desired length of the handle portion of a bag of the present invention would typically measure about 5" to 9", perhaps more, for medium- and larger-sized bags. For smaller bags they may be from 3" to 4". Whatever the length, it is desirable to have the stress transfer tips (STTs) and low points (LPs) positioned and measured according to the specifications herein in order to efficaciously dispense, and ultimately set-up and load a bag.

D. Description of a Preferred Version of a Bag of the Present Invention

Figure 4A:
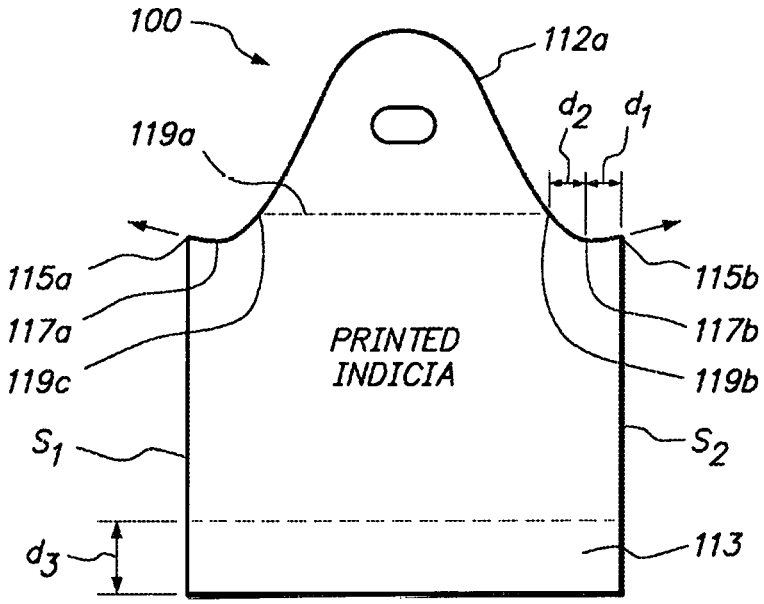
FIG. 4A is a plan view (in its layflat configuration) illustrating the exemplary bag in FIGS. 1B-3C, whereas the handle portions are pre-creased, allowing them to fold out of the way, making the bag easier to load.

As illustrated in FIG. 4A, the preferred bag 100 of the present invention incorporates a bell top shape sufficiently long to allow handle portions 112*a* and 112*b* (not shown) to fold down as illustrated in FIG. 3C, and includes a slight upward arc (illustrated by arrows) on its outer die-cut extremities, STTs 115*a* and 115*b*, which help prevent zippering or tearing downward along sideweld seals S1 and S2. The STTs 115*a* and 115*b* form the outer points that define the lower extremities of handle portions 112*a* and 112*b*, and are typically located about ⅓ the way down from the top of the handle to allow for the handle portions 112*a* and 112*b* to easily fold over, out of the way, facilitating loading as illustrated in FIG. 3C.

Continuing on with FIG. 4A, located just inside STTs 115*a* and 115*b* are valleys with their LPs (low points) 117*a* and 117*b*; which LPs provide a natural fold-inducement point for handle portions 112*a* and 112*b*. The handles 112*a* and 112*b* tend to fold somewhat further inside of the LPs 117*a* and 117*b*, as illustrated by fold line 119*a* (illustrated by a dotted line), which is slightly above the LPs. The distance d1 from an LP to a STT is approximately ¼ the dimension of the overall bottom gusset width, and the distance d2 from an LP to an outer point, such as from 117*b* to 119*b* of fold line 119*a* is also approximately ¼ the dimension of the overall bottom gusset width. Together they equal about ½ of the overall bottom gusset width and with a minimum amount of urging a user may fold over handles 112*a* and 112*b*, which creates a bag mouth opening 111 that takes on similar dimensions to the bottom gusset configuration (see FIG. 3C). The ½ width dimension on any two outer handle portions equals the width of the bottom gusset d3 in a layflat position, thus the bag mouth opening tends to take on a similar size configuration as an opened-up bottom gusset resting atop a countertop surface.

This natural fold over phenomenon is important when preparing bags of the present invention for loading as illustrated in FIG. 3C as they will naturally stand-up without the support of bag racks and holders. The LPs may be located as far from the STTs as ½ the distance of the bottom gusset width with substantially the same result. It may also be located somewhat nearer, for example ⅕ of the bottom gusset width with a similar effect, only that the opened bag mouth tends to be somewhat narrower than the bottom gusset width. Either way, the formation of the STTs and LPs of the present invention provide a superior means of preparing an otherwise flimsy plastic bag for loading. This is particularly important with thin-gauged reusable bags in the 2 mil to 6 mil variety, although it actually performs well in bag thicknesses as light as 0.5 mil. Common prior art wave-top bags made in high or low density polyethylene do not have this quality as they do not have LPs nor STTs and their handles must be forcibly folded over and the bag mouth opening forcibly formed. It is also interesting to note that STTs and LPs have no effect at all on the squaring-out, and standing up of a bag of the side gusset variety such as the sculptured bags and T-shirt bags of the varieties in U.S. Pat. No. 4,759,639 to DeMatteis.

The natural folding line 119*a* may be further accentuated by pre-creasing the bag film along the fold line. Pre-creasing may be done in any number of ways, for example though compression in a creasing operation such as that described in U.S. Pat. No. 6,319,184 to DeMatteis et al., or if bags are made in a sideweld bag making operation, a narrow steel wheel about 1/32" to 1/16" wide can be placed inline in the machine direction of the web, with a platen fixed directly below the wheel under the web, thus creasing along the entire width of the bags as the web passes under the wheel, which is compressed against the underlying platen.

Figure 4B:
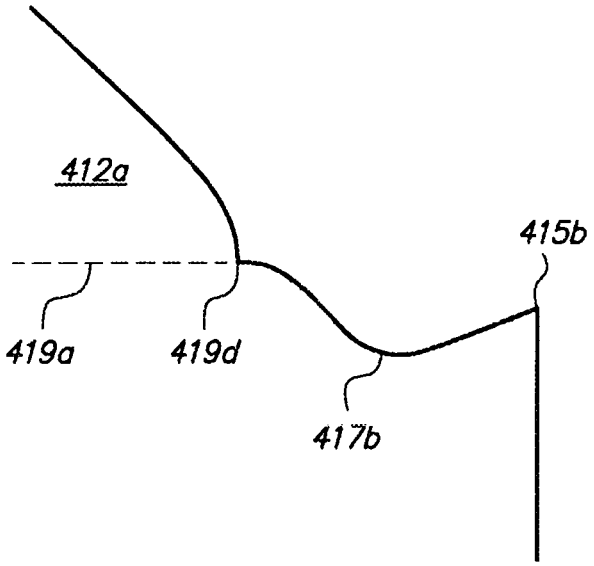
FIG. 4B is a blown up plan view of the outer handle portions of a variation of the bag shown in FIG. 4A.

Likewise, as illustrated in FIG. 4B a variation on a folding line 419*a* may further induce folding by incorporating an inward (or downward) notch 419*d* at an outer point of folding line 419*a*. As illustrated, notch 419*d* will tend to initiate a fold at that point, similar to that of an adjacent LP. Notches would be incorporated in the dies that shape the handle portions of a bag of the present invention.

While the STTs, LPs and notches may appear simple, somewhat obvious even, they are not. The sheer number of patented inventions over the past fifty years attempting to create thinner-gauged plastic stand-up bags is too great to list herein. In addition, those that have accomplished the feat, either use racks, holders, complicated creasing, gusset folding, and so on. The sheer simplicity of a user dispensing a bag such as that of the present invention, snapping it open, and instantly setting it upright for loading represents an enormous cost savings and space savings, with essentially no employee or user training required.

E. Description of Variations

It will be appreciated that the variations discussed herein may be used in combination with or in place of the features of the prior embodiments discussed above. Referring now to FIG. 5A, an alternative dispenser, generally designated 510, similar to dispenser 10 illustrated in FIGS. 1A and 1B and wherein like components may be numbered alike, consists of a top panel 520, an opposing bottom panel 530, a pair of opposing side panels 540 and 550, a front end panel 560, and an opposing rear end panel 570 (FIG. 5B) defining an article storage chamber 531. The top panel 520 includes a perforated dispensing cut-out 512 defined by a rear line or edge 514 extending across the top panel 520 from a point 515*a* recessed from a carton side edge 532 to a point 515*b* recessed from a carton side edge 542, two side lines 516*a* and 516*b* which are connected to rear line 514 at points 515*a* and 515*b* respectively and extend frontward in a more or less rectangular configuration to points 517*a* and 517*b* located just inside front panel edge 562. A separator line 519 extends between points 517*a* and 517*b* and is perpendicular to lines 516*a* and 516*b* and serves as a separator 518 at a medial location, even though it has no rearward extension or extremity. As illustrated, a first bag 100 is ready for dispensing similar to that of bag 100 in FIG. 1B, whereas top handle portion 112*a* extends outside of dispensing cut-out 512 and rests atop the separator 518 at a medial location on line 519. The disposition of top handle portion 112*a* is freely separated from its opposing bottom handle portion 112*b*, and allows bag 100 to be dispensed in an open disposition as previously illustrated herein in FIGS. 3A and 3B. As is understood, a suitable separator for bags in a bag stack of the present invention is not limited by shape, but is defined by a portion of a carton, such as separator line 519 and whereas top handle portions are in a juxtaposition to be indexed as they are dispensed in much the same manner as described in FIGS. 3A and 3B.

Figure 5B:
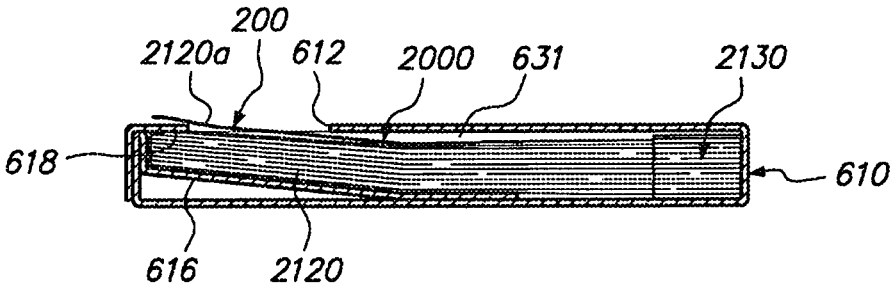
FIG. 5B is a side cutaway view of the carton and bag packs of FIG. 5A taken along lines 5B-5B and showing a ramp to compensate for varying bag thicknesses.
Figure 5C:
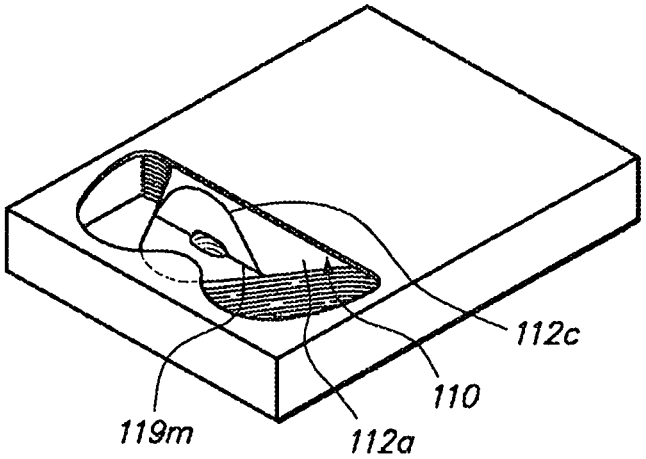
FIG. 5C is a similar view to FIG. 5A illustrating an exemplary means to prepare a first bag in a bag pack for instant dispensing.

Turning now to the cross-section of FIG. 5B, another exemplary embodiment of a carton 610 with an article storage chamber 631 much like those illustrated herein is shown with a bag pack 2000 aligned with its top handle portions 2120 faced in a frontward disposition. The handle portion rest atop a ramp 616 positioned just below dispensing cut-out 612, with the top handle portions 2120*a* of a first bag 200 resting in an open disposition atop separator 618, ready for dispensing, much like other bags of the present invention previously described. In this particular carton 610, the ramp 616 assists in compensating for the added thickness of bottom gussets 2130 of the bags of bag pack 2000. Since the space taken by the 4-ply thickness of bottom gussets 2130 is essentially twice that of the 2-ply thickness of the top handle portions 2120, the ramp 616 maintains the top handle portions 2120 in an elevated disposition, nearer dispensing cut-out 612, improving the dispensing operation. This configuration also provides a tighter package improving its ability to be stacked, palletized, and shipped long distances.

Referring now to FIG. 5C, an alternative means facilitates the ease of grasping a top handle portion 112*a* of a first bag 110 in a bag pack (for example, when a carton is first opened) by simply folding over top handle portion 112*a* along fold line 119*m* typically located about 2" to 4" down from the top of the bag 110, forming fold-over portion 112*c*. With the natural memory of plastic film, fold-over portion 112*c* tends to "stick up", however slight that may be. Thus the user reaches down and grasps fold-over portion 112*c* and dispenses the top bag 110 much like that described herein in FIGS. 3A and 3B. The second bag in sequence (not shown) is then pulled upward ready for dispensing as illustrated in FIG. 1B and further described in FIGS. 3A and 3B due to its interconnection with its underlying bag 210 (not shown).

Figure 6A:
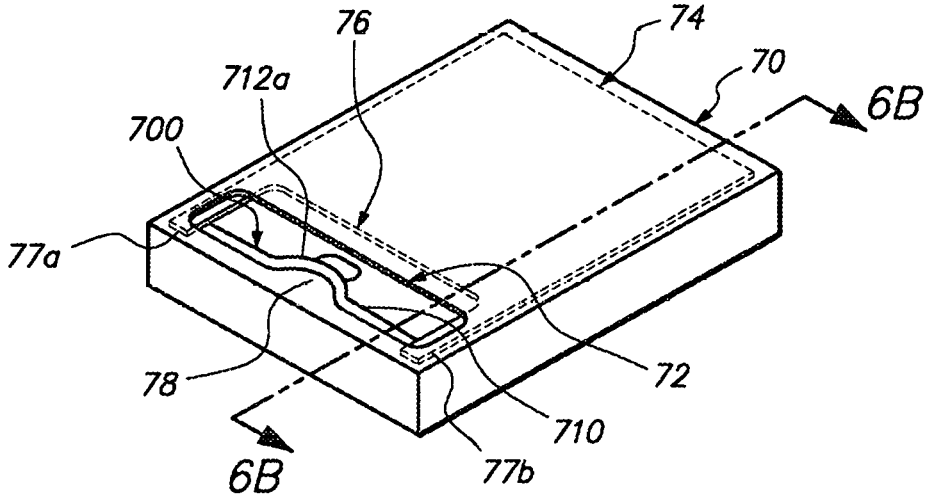
FIG. 6A is a similar view to FIG. 1B illustrating another embodiment of a carton and loaded article (bag) stack in accordance with the principles of the present invention for dispensing lightweight bag and sheet articles.
Figure 6B:
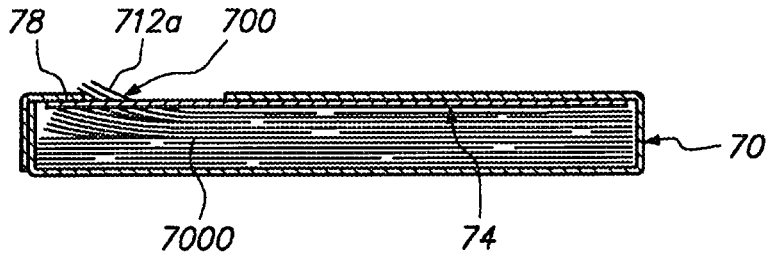
FIG. 6B is a side cutaway view of the carton and bag stack of FIG. 6A taken along lines 6B-6B and depicting a retainer to help maintain the bag stack in a layflat disposition thus preventing bag articles from bunching up when dispensed.

With reference to FIG. 6A, another exemplary carton, generally designated 70, constructed in accordance with the principles of the present invention is shown and is much like that of carton 10 in FIGS. 1A and 1B with a first bag 700 ready for dispensing, with the top handle portion 712*a* of top bag wall 710 extends only slightly outside of a dispensing cut-out 72 and tends to butt up against separator 78. The top handle*portion 712*a* is freely separated from its opposing bottom handle portion (not shown) of the bottom bag wall (not shown), and allows the bag 700 to be dispensed in an open disposition as previously described herein. The cut-out 72 as illustrated is smaller, narrower, than that of FIGS. 1A and 1B, thereby restricting the interconnected bags being dispensed, and allowing only the top bag to be extracted. The bags in the underlying bag pack 7000 as illustrated in FIG. 6B are further maintained in an integral interconnected stack by retainer 74 that rests atop the internal bag pack. Retainer 74 is a die-cut piece of cardboard as illustrated and performs its operation by maintaining its weight atop bag pack 7000. In addition, due to its size being substantially long, it prevents the subsequent bags in bag pack 7000 to bunch up, as the uppermost bags are being dispensed. At the forward-most location is retainer die-cut 76, which allows bags to be dispensed through dispenser cut-out 72 and also forms two extensions 77*a* and 77*b*, which extensions maintain retainer 74 securely atop bag stack 7000, and spaced rearward during dispensing. It is easy to see that the withdrawal of a single bag would cause the retainer to slide forward and close off dispenser cut-out 72 without the two extensions 77*a* and 77*b*.

The disposition of a first bag 700 in carton 70 as illustrated occurs automatically after the dispensing of each previously dispensed bag in the same manner as described in FIG. 1B, regardless of whether the bag has a die-cut handle or not. The primary difference between the bags dispensed from FIG. 6A is that they are very lightweight bags, such as those under 0.0007 mil thickness. The narrow, restricting dispensing cut-out 72 helps maintain the bag stack in place inside carton 70, thus assisting in effecting the one-at-a-time dispensing. As can be understood, the bond between the bags in a bag stack of lightweight bags would tend to cause bags to accordion-out of the dispenser (attached to one another) as the bonds would be strong enough to cause the multiple dispensing. The carton and dispensing system of the present invention is not reliant on a bell shape of a lightweight bag, but may be affected with traditional flat topped bags, providing they are interconnected with some sort of bond between the outer layers.

As shown in FIG. 6B the side cutaway view of carton 70 of FIG. 6A illustrates the positioning of retainer 74 as it maintains bag pack 7000 in place, with top handle portion 712*a* of first bag 700 butted up against separator 78 and ready for dispensing.

Figure 7:
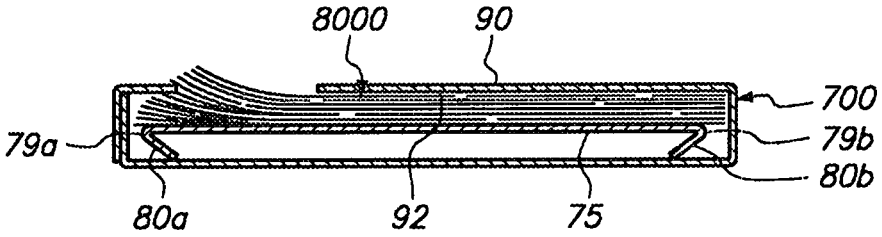
FIG. 7 is a similar view to FIG. 6B of an exemplary carton and bag stack including an elevator that helps maintain a stack of articles in a layflat disposition thus preventing bag articles from bunching up when dispensed.

Turning now to FIG. 7, another exemplary carton, generally designated 700, is the same as that in FIGS. 6A and 6B. In this example, however, there is no internal retainer 74 (FIG. 6B) that would maintain a bag stack in place while bags are being dispensed. In its place is an elevator 75, located beneath a bag pack 8000. The elevator more or less serves the same function of maintaining bag pack 8000 in its integral disposition as the retainer 74 (FIG. 6B). In this partially dispensed carton, the elevator 75 as illustrated is a piece of corrugated carton folded at locations 79*a* and 79*b* forming end pieces 80*a* and 80*b*. It is placed underneath bag pack 8000 prior to packing the stack in carton 700. With the two end pieces 80*a* and 80*b* folded under as illustrated, there is a natural pushing-up effect (PUE) that always pushes up the lightweight bags in bag pack 8000 upwards inside carton 700, and up against the inside wall 92 of carton top panel 90. In this respect, the carton top panel 90 acts as a retainer, much like that of retainer 74 of FIGS. 6A and 6B. Likewise the upward pressure of elevator 75 further serves to retain bag pack 8000 in its integral layflat disposition while a first article is being dispensed. The means to ensure that elevator 75 has sufficient force to push up lightweight bag pack 8000 is based on the two end pieces 80*a* and 80*b* measuring somewhat longer than the internal height of the carton. Corrugated creased and folded over as illustrated maintains its natural substantial memory. Even after weeks of being in a 100% folded-over and back disposition—such as during shipment and storage—it will still have sufficient memory to push up a bag stack as illustrated. For example, if the internal height of a dispenser carton of the present invention is 1", then the two end pieces would be about 1¼" in length up to perhaps 1½". The PUE phenomenon works even with a single end piece (such as 80*a*) located at the forward most location, below the dispenser opening. While one end piece may be sufficient, two are usually better. At times the use of an elevator with lightweight bottom gusted bags may not require having an end piece (such as 80*b*) located in the rearward location. As previously described, the individual bags in FIG. 7 dispense in substantially the same manner as those in FIGS. 6A and 6B.

Figure 8A:
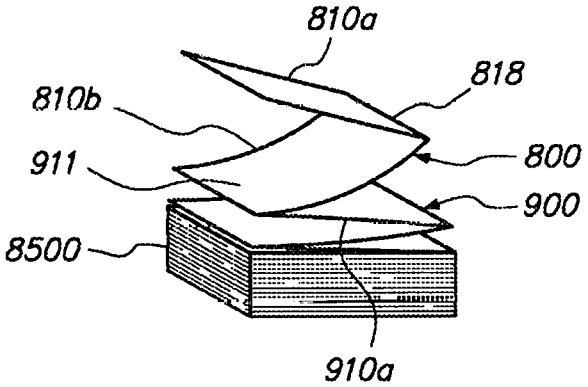
FIG. 8A is an upper, right hand, perspective view of an exemplary set of tissue articles folded in accordance with the principles of the present invention illustrating the accordion effect of their interconnections.

Turning now to FIG. 8A, a folded tissue article stack 8500 constructed in accordance with the principles of the present invention includes an individual top sheet 800 with a top tissue wall 810*a* folded along fold line 818 and connected to a bottom tissue wall 810*b*. The bottom tissue wall 810*b* is interconnected to a second tissue 900 at its top wall 910*a*, at or near end location 911, and so on down through the stack. The interconnected bonds are made in much the same manner as previously described in FIG. 2A, when making a die-cut on a stack of tissue articles or by treating the film, and applying pressure, using stacking pins, and so on. For example, a single layflat tube segment may be die-cut it in the middle making two opposing tissue stacks (each one is a C-fold layflat segment). The accordion-effect with its interconnections dispenses tissue articles in much the same manner as bags, only each dispensing of a first article unfolds a top wall portion of a second tissue article lying underneath. Interconnected sheet articles as illustrated dispense much in the same manner as previous described with the bags, having a top wall portion always ready to grasp and extract.

Figure 8B:
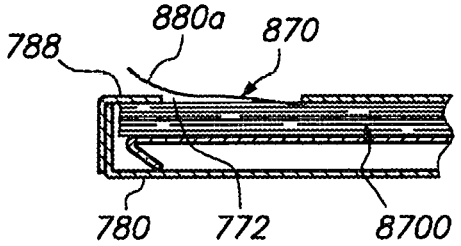
FIG. 8B is a broken side cutaway view of the dispensing end of the dispenser carton in FIG. 7 illustrating the tissue or sheet articles of the present invention in a ready to dispense configuration.

With reference to FIG. 8B, a partially dispensed stack of tissue articles 8700 (FIG. 8A) is loaded inside a carton, generally designated 780, with a first tissue article 870 having its top wall 880*a* extending outside a dispensing die-cut 772 and resting atop separator 788. The carton 780 and its components and structure are much like that of the carton in FIG. 7, with adjustments for the size of the articles dispensed therein. Dispensing a first tissue article 870 is much like dispensing any subsequent bag or tissue as previously described herein. In other words, the extraction of a first article automatically positions a second article above the dispensing die cut making it ready for dispensing.

Figure 9A:
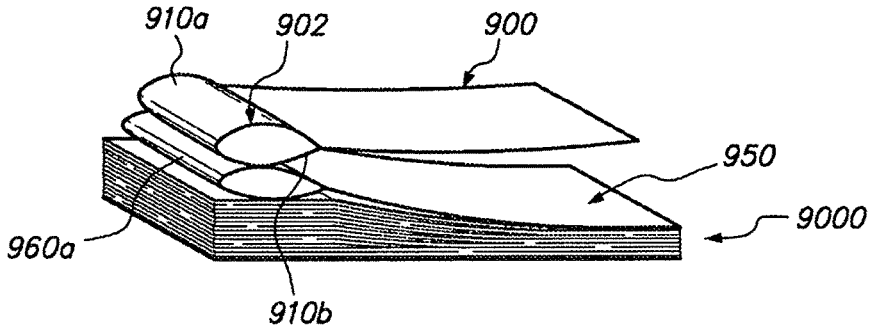
FIG. 9A is an upper, left hand, perspective view of a set of exemplary tint strip articles constructed in accordance with the principles of the present invention with apertures located on one end, and illustrating the accordion effect of their interconnections.

Now turning to FIG. 9A, a tissue article stack 9000 constructed in accordance with principle of the present invention includes an individual top sheet 900 (that may be used, for example, as a tint strip in the salon trade) with an aperture 902 located on a forward-most location. The aperture 902 is made in a layflat disposition with a top wall 910*a* and bottom wall 910*b*. As illustrated, the bottom wall 910*b* of the aperture 902 is connected to the underlying top wall 960*a* of second tint strip 950. This interconnection and all subsequent ones are made much in the same manner as illustrated herein. The purpose of the aperture in the tint strip tissue, commonly used in hair styling salons, is to allow the hair stylist to slip a rat tail comb through the aperture and extract a tint strip. The accordion effect with its interconnections on the aperture walls allows tint strip articles to be dispensed in much the same manner as bags or folded tissue as previous revealed herein, only each dispensing of a first article opens up a top aperture wall of a second interconnected article in a similar manner as provided by the spirit of the present invention. A tint strip is therefore always ready to extract and put in use.

Figure 9B:
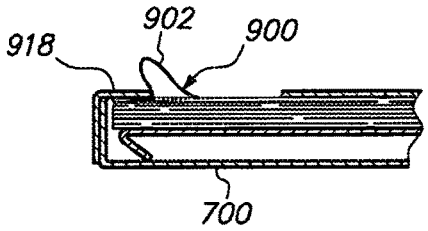
FIG. 9B is a similar view to FIG. 8A with the exemplary set of tint strips loaded in the carton and illustrating how the tint strip articles with their apertures may be placed in a ready to dispense configuration.

With reference to FIGS. 7, 9A, and 9B, an exemplary carton 700 such as that shown in FIG. 7, may be loaded with a first tint strip tissue article 900 ready for dispensing. In this configuration, when the traverse aperture 902 located at the forward end of tint strip 900 is pushed up against separator 918, it causes aperture 902 open from its layflat position to its open disposition (as illustrated), thus ready to be extracted. It is now easy to see that a hair stylist can slip the thin handle of a rat tail comb into first tint strip aperture 902 and efficaciously extract all of tint strip 900. Upon extraction, the underlying second tint strip in the stack is automatically positioned in the same open disposition. This dispensing operation then continues throughout the entire stack of tint strips packed in the carton.

Figure 10A:
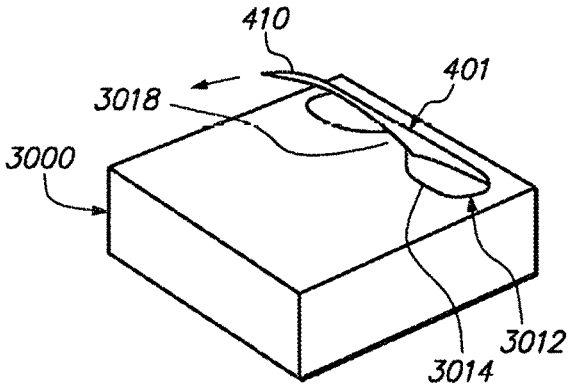
FIG. 10A is an upper, right hand, perspective view of another exemplary dispenser carton constructed in accordance with the principles of the present invention along the lines of the embodiment shown in FIG. 6A but with a rearward positioned separator.

Moving on to FIG. 10A, a stack of tissue articles may be inserted into another exemplary carton, generally designated 3000, with the open ends of the folded tissues in tissue stack (not shown but contained within carton 3000) positioned rearward. In carton 3000, the separator 3018 is located on the rearward edge 3014 of dispensing die-cut 3012. Thus, the dispensing of each article takes place as previously described herein, except that the top sheet wall 410 of first tissue 401 faces rearward (arrow) instead of toward the front near the carton's front end. Once again, dispensing occurs in the spirit of the present invention. It is also interesting to note that other configurations of bag or film articles may be dispensed by locating a separator on one of the two sides of a dispenser cut-out opening. In such a case the fold in tissue articles would be positioned sideways, and likewise, with bag articles it would index the second bag in a bag pack by separating a top bag wall from the side of the bag; for example along the side of a bell-shaped top portion.

Figure 10B:
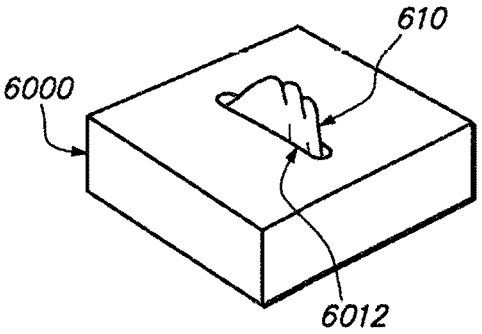
FIG. 10B is an upper, right hand, perspective view of a dispenser carton with a narrowed dispensing opening that serves to help restrict a subsequent article being dispensed.

Referring now to FIG. 10B, another exemplary carton, generally designated 6000, includes a narrow dispenser opening 6012 without a separator element, and may be constructed much like any of the previous cartons, with or without a retainer or elevator. The narrow dispenser opening 6012 serves the purpose of allowing interconnected tissue or bag articles to be dispensed by pulling a first article 610 upward, out of dispenser opening 6012, which extracting operation pulls a second article (not shown) upward, and through the dispenser opening. The second bag is separated from its interconnection with a first bag due to the stronger resistance of the narrow dispenser opening 6012. In other words, the extracting operation has enough force to withdraw only a portion of a second interconnected article up through the restrictive dispenser opening before the interconnecting bonds are broken by the restrictive opening.

Consistent with the spirit of the present invention, interconnected articles—bags, tissues, sheets, strips, and the like—may be efficaciously dispensed from cartons that contain cooperative dispenser openings that may or may not restrain, with or without a separator, with or without a retainer, and with or without an elevator. These configurations may be located anywhere on a carton's top surface, even on a side or front panel, or on the top, side or front surface of a fixed dispenser. It may also include more than one dispensing system, for example two cut-outs placed side by side with two article packs inside the carton, or two that are located at opposite ends. The dispensers and dispensing systems of the present invention may be mounted horizontally, vertically, even upside-down. There is no need to incorporate a fully enclosed article storage chamber or use rigid panels. Instead, as described above in the exemplary embodiments constructed in accordance with the principles of the present invention, the interaction between a cut out in at least one dispenser surface with the article stack located to one side of the dispenser surface for subsequent withdrawal through the cut out being the primary focus.

The bag cartridges of the present invention may likewise be releasably attached to the dispenser (carton or permanent) to improve the efficacious dispensing of the last bags in the stack. The spirit of the present invention provides a breadth of scope that includes all dispensing of interconnected articles through all cooperative dispenser configurations, regardless of construction. It also covers broad methodologies of automating, partially or in whole, the manufacture of the bags and cartridges of the present invention with its many variables including insertion into a dispenser carton. Any variation on the theme and methodology of accomplishing the same that are not described herein would be considered under the scope of the present invention.

What is claimed is:

1. A dispenser for storing and dispensing a plurality of articles comprising:

a dispenser body including a bottom panel, an opposing top panel, a pair of opposing side panels, and a pair of opposing front and rear panels, the panels cooperating to define an article storage chamber;

a stack of bags with each bag having opposing front and back sections joined at their respective side edges and further joined at a bottom gusset that expands a bag bottom to assist the bags in standing upright when opened, each bags further including an outermost centrally disposed handle extending from the front section and defining a first grasping region with an outermost handle aperture and an opposing innermost centrally disposed handle extending from the rear section, the handles at least partially surrounding a bag mouth, the bags being separably interconnected by adjacent handles to other adjacent bags in the stack by a weak bond, the stack of bags being initially disposed within the article storage chamber in a substantially parallel, accordion-like arrangement with their respective handles facing toward the front panel of the dispenser body and the handle apertures aligned with the outermost edges of the entire stack of bags being free of any direct connection to the dispenser body; and an extraction site defining an opening in the least one panel of the dispenser body leading to the article storage chamber, the opening including a leading edge and an opposing straight trailing edge, the leading edge including a rearwardly projecting, centrally disposed, separator element proximate the bag handles located within the article storage chamber, the separator element being constructed to slidingly engage the innermost handle of an outermost bag following withdrawal of the outermost bag when directly withdrawing the first grasping region of the outermost handle of the outermost bag toward the leading edge and away from the article storage chamber to open the bag mouth, the separator element further being constructed to further engage the innermost handle of an adjacent bag as the outermost bag is further withdrawn from the article storage chamber to assist in severing the weak bond between the outermost bag and the adjacent bag, the weak bond being constructed to be sufficiently strong to raise the outermost handle of an adjacent bag above the separator as an outermost bag is being withdrawn but further constructed to release the adjacent bag once the outermost handle of the adjacent bag has cleared the separator and is outside the article retention chamber, and then receive the first grasping region of the adjacent bag in a position exterior to the article storage chamber to index the first grasping region of the adjacent bag in the stack in a ready to grasp position outside the article storage chamber and against at least a portion of the separator element after the outermost bag is separated from the adjacent bag in the stack during withdrawal wherein the bags may be selectively withdrawn one at a time with each bag being indexed in turn.

2. The dispenser of claim 1 wherein:

the opening in the at least one panel further includes a trailing edge and a pair of opposing side lines constructed to engage an adjacent bag once the bottom edge of the outermost bag is withdrawn through the extraction site to assist in severing any remaining connection between the outermost bag and the adjacent bag.

3. The dispenser of claim 1 wherein:

the weight of the stack assists in severing a connection between the outermost bag and an adjacent bag as the outermost bag is withdrawn through the extraction site.

4. The dispenser of claim 1 wherein:

the leading edge includes a compound curve with a centralized tongue portion extending rearwardly toward a but recessed from the straight trailing edge of the opening.

5. The dispenser of claim 1 wherein:

the opening is disposed within a top panel of the dispenser body with the leading edge, the straight trailing edge, and the separator disposed in the same plane as the surface of the top panel; and the stack of bags lay flat in the article storage chamber with the handles and handle apertures substantially parallel to, the opening.

6. The dispenser of claim 1 wherein:

at least one edge of the opening restrains more than one bag from being withdrawn at a time.

7. The dispenser of claim 1 wherein:

the opening is formed by removing a perforated cut-out section from at least one panel of the dispenser body.

8. The dispenser of claim 1 further including:

a ramp positioned atop an interior surface of the bottom panel and angled upwardly toward the top panel, the ramp constructed to at least partially elevate the front panel end of the stack of bags.

9. The dispenser of claim 1 further including:

a flat retainer element disposed within the article storage chamber beneath an interior surface of the top panel and resting atop and disconnected from the stack of bags, the retainer element extending at least partially between the front and rear panels and including a pair of spaced apart arms extending from an intermediate point along the interior surface of the top panel to either side of the extraction site toward the front panel and constructed to inhibit a plurality of interconnected bags from bunching up within the article storage chamber.

10. The dispenser of claim 1 further including:

an elevator element with a main platform supporting the stack of bags and at least one leg projecting at an angle relative to the main platform and abutting the interior surface of the bottom panel to exert an upward pressure on the stack of bags against the interior surface of the top panel.

11. The dispenser of claim 1 wherein:

the bottom surface of the stack of bags is separably attached to an interior surface of the bottom panel of the dispenser body to assist in severing adjacent bags as the stack grows smaller.

12. The dispenser of claim 1 wherein:

the dispenser body is oriented with the top panel in a horizontal plane; and the handle apertures of the stack of bags are aligned in the same plane as the opening of the extraction site.

13. The dispenser of claim 1 wherein:

the withdrawal of each bag completely through the opening of the extraction site leaves no portion of the bag being withdrawn behind in the article storage chamber.

14. The dispenser of claim 1 wherein:

the weak bond between adjacent bags is formed by a die-cutting compression.

15. The dispenser of claim 1 wherein:

the weak bond between adjacent bags is formed by a static electric treatment applied to adjacent bag surfaces.

16. The dispenser of claim 1 wherein:

the opening of the extraction site includes the straight trailing edge transitioning to a pair of opposing side lines which in turn transition to the leading edge, the leading edge including two opposing curves facing the trailing edge and a central curve facing away from the trailing edge with a rearmost extent of the central curve being recessed from the straight trailing edge.

17. The dispenser of claim 1 wherein:

each bag in the stack of bags includes a set of curved centrally disposed outermost and innermost handles with opposing shoulder areas extending to the sides of the bag.

18. The dispenser of claim 1 wherein:

the outermost bag of the bag stack is withdrawn from the article storage chamber through the extraction site by directly engaging the outermost handle aperture within the first grasping region of the outermost bag.

19. A dispenser for storing and dispensing a plurality of articles comprising:

a dispenser body including a top panel and a front panel forming a portion of an article storage chamber;

a stack of bags with each bag having opposing front and back sections joined at their respective side and bottom edges and further including an outermost centrally disposed handle extending from the front section and defining a first grasping region with an outermost handle aperture and an opposing innermost handle extending from the rear section with the handles at least partially surrounding a bag mouth with the bags being separably interconnected by adjacent handles to other adjacent bags in the stack of bags by a weak bond, the stack of bags being initially disposed within the article storage chamber with the outermost bag atop an adjacent bag in a substantially flat parallel arrangement with the outermost edges of their respective handles facing toward the front panel of the dispenser body and the handles and handle apertures aligned and parallel to a plane passing through the top panel with the outermost edges of the entire stack of bags being free of any direct connection to the dispenser body; and an extraction site defining an opening in the least one panel leading to the article storage chamber, the opening including a leading edge along the direction of bag withdrawal and an opposing trailing edge, the leading edge including a rearwardly projecting separator element proximate the bag handles located within the article storage chamber, the separator element being constructed to slidingly engage the innermost handle of an outermost bag following withdrawal of the outermost bag when directly withdrawing the first grasping region of the outermost handle of the outermost bag over the leading edge and away from the article storage chamber to open the bag mouth, the separator element further being constructed to further engage the innermost handle of an adjacent bag as the outermost bag is further withdrawn from the article storage chamber to assist in severing the weak bond between the outermost bag and the adjacent bag, the weak bond being constructed to be sufficiently strong to raise the outermost handle of an adjacent bag above the separator as an outermost bag is being withdrawn but further constructed to release the adjacent bag once the outermost handle of the adjacent bag has cleared the separator and is outside the article retention chamber, and then receive the outermost handle and corresponding handle aperture of the adjacent bag in a position exterior to the article storage chamber to index the outermost handle and corresponding handle aperture of the adjacent bag in the stack in a ready to grasp position against at least a portion of the separator element after the outermost bag is separated from the adjacent bag in the stack during withdrawal wherein the bags may be selectively withdrawn one at a time with each bag being indexed in turn.

* * * * *